US011181106B2

(12) United States Patent
Alexander et al.

(10) Patent No.: US 11,181,106 B2
(45) Date of Patent: Nov. 23, 2021

(54) PUMP ASSEMBLY WITH ELECTRIC STARTER

(71) Applicant: FNA Group, Inc., Pleasant Prairie, WI (US)

(72) Inventors: Gus Alexander, Inverness, IL (US); Paulo Rogerio Funk Kolicheski, Gurnee, IL (US)

(73) Assignee: FNA GROUP, INC., Pleasant Prairie, WI (US)

( * ) Notice: Subject to any disclaimer, the term of this patent is extended or adjusted under 35 U.S.C. 154(b) by 642 days.

(21) Appl. No.: 15/612,543

(22) Filed: Jun. 2, 2017

(65) Prior Publication Data

US 2017/0350386 A1 Dec. 7, 2017

Related U.S. Application Data

(60) Provisional application No. 62/345,246, filed on Jun. 3, 2016.

(51) Int. Cl.
*F04B 49/02* (2006.01)
*F04B 1/12* (2020.01)
(Continued)

(52) U.S. Cl.
CPC ..... *F04B 49/02* (2013.01); *B08B 3/02* (2013.01); *B08B 3/026* (2013.01); *F04B 1/128* (2013.01);
(Continued)

(58) Field of Classification Search
CPC .... B08B 2203/0223; B08B 2203/0241; B08B 2203/027; B08B 2203/0294; B08B 3/02; F02N 11/00; F02N 11/0851; F02N 15/006; F02N 15/02; F04B 17/05; F04B 17/06; F04B 1/128; F04B 1/14; F04B 1/146; F04B 49/02; F04B 53/14
See application file for complete search history.

(56) References Cited

U.S. PATENT DOCUMENTS 4,515,533 A * 5/1985 Gomez ..... F16D 23/12 192/114 R
5,085,953 A 2/1992 Hayashi et al.
(Continued)

FOREIGN PATENT DOCUMENTS

CN 2786335 Y 6/2006
CN 201982539 U 9/2011
CN 102459844 A 5/2012

OTHER PUBLICATIONS

Office Action dated Apr. 12, 2018 in counterpart Canadian Patent Application No. 2968937.
(Continued)

*Primary Examiner* — Dominick L Plakkoottam
(74) *Attorney, Agent, or Firm* — Steven E. Jedlinski; Jeffrey T. Placker; Holland & Knight LLP

(57) ABSTRACT

In an embodiment, a pump assembly may include a mounting structure and a pump mechanism and a starter motor coupled to the mounting structure. The pump mechanism may include an input shaft configured to be rotatably coupled with an output shaft of a prime mover engine. The starter motor may be coupled with the input shaft of the pump mechanism for rotatably driving the input shaft of the pump mechanism.

18 Claims, 11 Drawing Sheets

(51) Int. Cl.

| | |
|---|---|
| ***F04B 1/14*** | (2020.01) |
| ***B08B 3/02*** | (2006.01) |
| ***F04B 53/14*** | (2006.01) |
| ***F04B 17/05*** | (2006.01) |
| ***F04B 1/128*** | (2020.01) |
| ***F04B 1/146*** | (2020.01) |

(52) U.S. Cl.

CPC ..... *F04B 1/146* (2013.01); *F04B 17/05* (2013.01); *F04B 53/14* (2013.01); *B08B 2203/027* (2013.01); *B08B 2203/0241* (2013.01)

(56) References Cited

U.S. PATENT DOCUMENTS 7,086,226 B2 * 8/2006 Oguri ..... F04B 17/05 60/414
8,689,759 B2 * 4/2014 Schultz ..... F16H 61/0028 123/179.31
8,727,233 B2 5/2014 Karp
2003/0035734 A1 * 2/2003 Vukovich ..... B60K 25/00 417/223
2003/0103850 A1 * 6/2003 Szulczewski ..... F04B 23/02 417/319
2006/0283185 A1 * 12/2006 Wrona ..... F04B 1/14 60/490
2008/0256950 A1 * 10/2008 Park ..... F02B 37/14 60/611
2009/0045271 A1 * 2/2009 Alexander ..... B08B 3/026 239/722
2011/0259016 A1 * 10/2011 Winston ..... F02C 7/26 60/778
2011/0315176 A1 * 12/2011 Gilpatrick ..... B08B 3/026 134/57 R
2012/0076675 A1 * 3/2012 Nomura ..... B60K 6/445 417/319
2012/0097124 A1 * 4/2012 Zhang ..... F02N 15/006 123/179.25
2012/0229005 A1 * 9/2012 Tominaga ..... H02K 11/38 310/68 B
2012/0248773 A1 * 10/2012 Whinnery ..... F02N 11/0866 290/46
2012/0260617 A1 * 10/2012 Gilpatrick ..... A01D 34/001 56/11.9
2013/0092745 A1 4/2013 Karp
2013/0111864 A1 * 5/2013 Hansen ..... B60T 7/042 56/10.8
2013/0343906 A1 12/2013 Funke et al.
2014/0033443 A1 * 2/2014 Flesch ..... D06F 23/04 8/137
2014/0119949 A1 5/2014 Wischstadt et al.
2016/0108881 A1 4/2016 Hansen et al.
2016/0252000 A1 * 9/2016 VanZuilen ..... F16D 41/088 123/41.02
2017/0204829 A1 * 7/2017 Hannah ..... F02N 5/04
2017/0304873 A1 * 10/2017 Luby ..... B08B 3/026

OTHER PUBLICATIONS

Office Action dated Jun. 14, 2018 in counterpart Canadian Patent Application No. 2974606.
First Chinese Office Action issued in CN Application Serial No. 201710407969.4 dated Sep. 20, 2018.
Official Communication of Substantive Requirements dated Aug. 8, 2021 in counterpart Mexican Patent Application No. MX/a/2017/007233.

* cited by examiner

PUMP ASSEMBLY WITH ELECTRIC STARTER

CROSS-REFERENCE TO RELATED APPLICATION

This application claims the benefit of U.S. provisional patent application Ser. No. 62/345,246, entitled "Pump Assembly With Electric Starter," filed on Jun. 3, 2016, the entire disclosure of which is incorporated herein by reference.

TECHNICAL FIELD

The present disclosure generally relates to pumps, and more particularly relates to pump assemblies including an electric starter for a prime mover engine.

BACKGROUND

Many domestic and commercial water usage applications may require relatively high pressures, which may be beyond the capacity of residential and/or municipal water distribution and supply systems. For example, heavy duty cleaning applications may benefit from increased spraying pressure that is greater than the pressure available for common residential and/or municipal water distribution and supply systems. In some situations, various nozzles may be utilized to constrict the flow of the water to provide an increase in the pressure of the resultant water stream. However, many tasks may benefit from even greater pressures than can be achieved with common pressure nozzles that may be attached to a hose. In such circumstances pressure washers may be utilized, in which a power driven pump may be employed to increase the pressure significantly above pressures that are readily achievable using hose attachments. Such elevated pressures may greatly increase the efficiency and/or effectiveness of some cleaning and spraying tasks.

Generally, the power driven pump of a pressure washer may be driven by any suitable engine or motor. In some situations, the power driven pump of the pressure washer may be driven by a gasoline, diesel, or propane engine. The use of such engine driven pressure washers may allow mobility in use of the pressure washer, in that the pressure washer may be operated in locations that may not have ready access to electrical connection and/or may eliminate the need for using and managing extension cords. Additionally, in some situations, the use of an engine driven pressure washer may reduce or eliminate at least some of the safety hazards associated with the operation of electrical equipment in wet environments, which may be created through the use of the pressure washer.

SUMMARY

According to an implementation, a pump assembly may include a mounting structure. The pump assembly may also include a pump mechanism coupled to the mounting structure. The pump mechanism may include an input shaft configured to be rotatably coupled with an output shaft of a prime mover engine. The pump assembly may also include a starter motor coupled to the mounting structure. The starter motor may be coupled with the input shaft of the pump mechanism for rotatably driving the input shaft.

One or more of the following features may be included. The mounting structure may be configured to be mounted to the prime mover engine. The mounting structure may be configured to be mounted to a pressure washer chassis. The prime mover engine may also be mounted to the pressure washer chassis. The pump mechanism may include an axial piston pump including one or more pistons driven by a swashplate rotatably coupled with the input shaft.

The starter motor may include one or more of a high speed DC motor, a brushless DC motor and a universal motor. The starter motor may be coupled with the input shaft of the pump mechanism by a mechanical coupling. The mechanical coupling may include one or more of a gear drive, a belt drive, a chain drive, and a friction wheel drive. The mechanical coupling may provide a mechanical multiplier to provide sufficient torque at the input shaft of the pump mechanism to start the prime mover engine. The starter motor may include one or more of a low speed DC pancake motor and a low speed switched reluctance motor. The starter motor may be assembled over the input shaft of the pump mechanism.

The pump assembly may further include a selective engagement mechanism coupled between the starter motor and the pump mechanism. The selective engagement mechanism may provide selective rotational driving engagement and disengagement between the starter motor and the input shaft of the pump mechanism. The selective engagement mechanism may include an overrunning clutch. The overrunning clutch may be configured to engage to allow transmission of rotational force from the starter motor to the input shaft of the pump mechanism. The overrunning clutch may be configured to disengage to prevent transmission of rotational force from the input shaft of the pump mechanism to the starter motor. The overrunning clutch may include an outer race portion surrounding at least a portion of the input shaft of the pump mechanism. The outer race portion may define one or more tapered pockets. A respective ball bearing may be disposed in each of the one or more tapered pockets. The input shaft may define an inner race portion. The respective ball bearings may interact between the inner race portion and the outer race portion.

The pump assembly may further include a power coupling for selectively coupling the starter motor with a power source for energizing the starter motor. The power coupling may include a battery coupling. The battery coupling may include a coupling for electrical connection with a battery of a battery powered tool. The power coupling may include a plug for coupling with a residential electrical system. The pump assembly may further include a starter control for selectively energizing the starter motor.

According to another implementation, a pump assembly may include a mounting structure. The pump assembly may also include an axial pump mechanism coupled to the mounting structure. The axial pump mechanism may include one or more piston pumps configured to be axially driven by a rotatably driven swashplate. The swash plate may be configured to be rotatably driven by an input shaft of the axial pump mechanism. The input shaft of the axial pump mechanism may be configured to be rotatably coupled with an output shaft of a prime mover engine. The pump assembly may also include a starter motor coupled to the mounting structure. The starter motor may be mechanically coupled with the input shaft of the pump mechanism through a gear train for rotatably driving the input shaft. The pump assembly may also include a selective engagement mechanism coupled between the starter motor and the axial pump mechanism. The selective engagement mechanism may provide selective rotational driving engagement and disengagement between the starter motor and the input shaft of the pump mechanism. The pump assembly may further include a battery coupling configured to electrically and mechanically couple with a battery of a battery powered tool. The battery coupling may be selectively electrically coupleable with the starter motor for energizing the starter motor.

One or more of the following features may be included. The mounting structure may be configured to be coupled with the prime mover engine. The selective engagement mechanism may include an outer race portion surrounding at least a portion of the input shaft of the pump mechanism. The outer race portion may define one or more tapered pockets. A respective ball bearing may be disposed in each of the one or more tapered pockets. The input shaft may define an inner race portion. The respective ball bearings may interact between the inner race portion and the outer race portion.

According to yet another implementation, a pressure washer may include a prime mover engine including an output shaft configured to be rotatably driven during operation of the prime mover engine. The pressure washer may also include a pump assembly mounting structure coupled to the prime mover engine. The pressure washer may also include a pump mechanism coupled to the pump assembly mounting structure. The pump mechanism may include an input shaft rotatably coupled with the output shaft of a prime mover engine. The pressure washer may also include a starter motor coupled to the pump assembly mounting structure. The starter motor may be coupled with the input shaft of the pump mechanism for rotatably driving the input shaft for starting the prime mover engine.

DESCRIPTION OF EXAMPLE EMBODIMENTS

Figure 1:
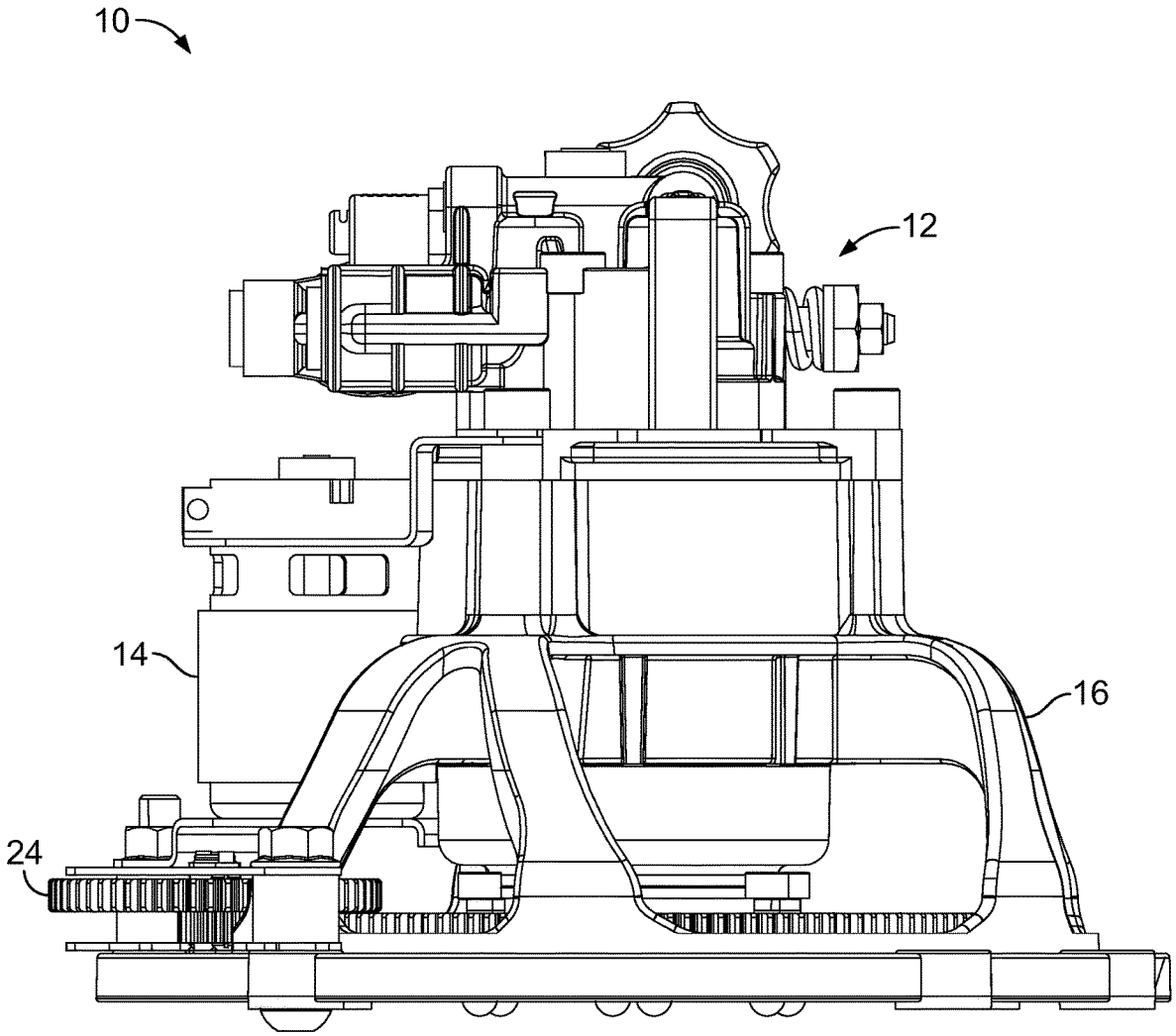
FIG. 1 is a front view of a pump assembly, according to an example embodiment.
Figure 2:
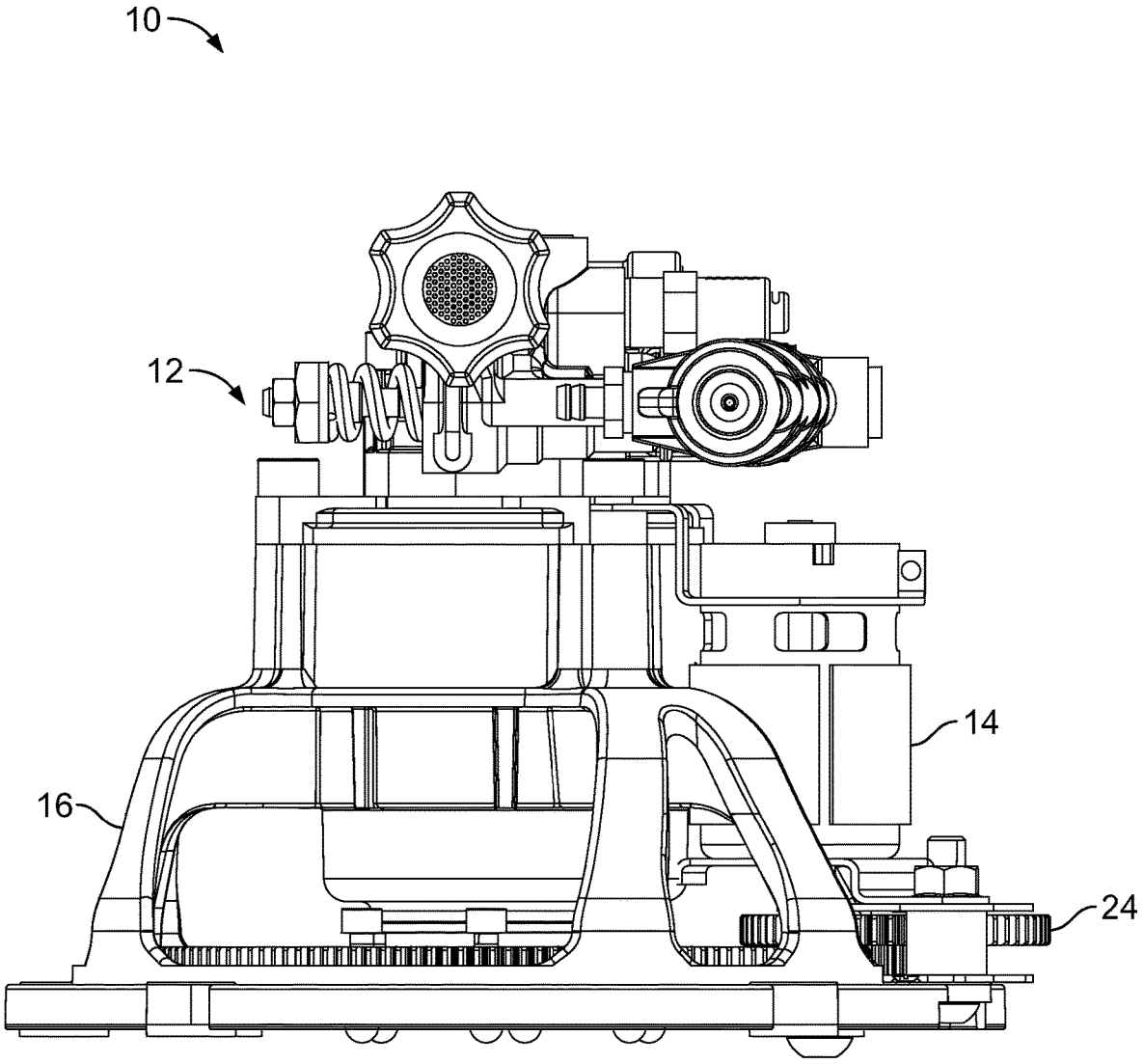
FIG. 2 is a rear view of the pump assembly of FIG. 1, according to an example embodiment.
Figure 3:
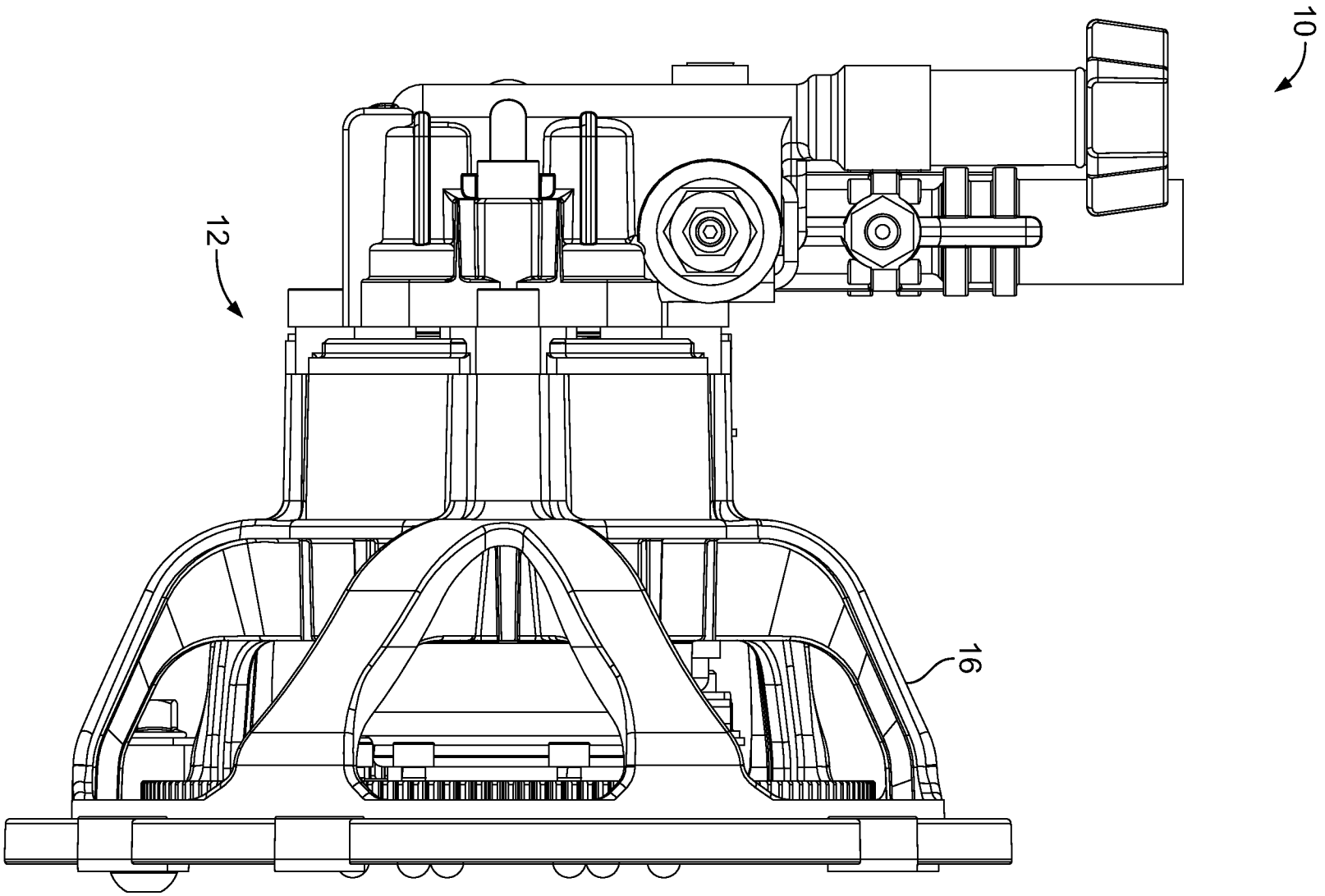
FIG. 3 is a side view of the pump assembly of FIG. 1, according to an example embodiment.
Figure 4:
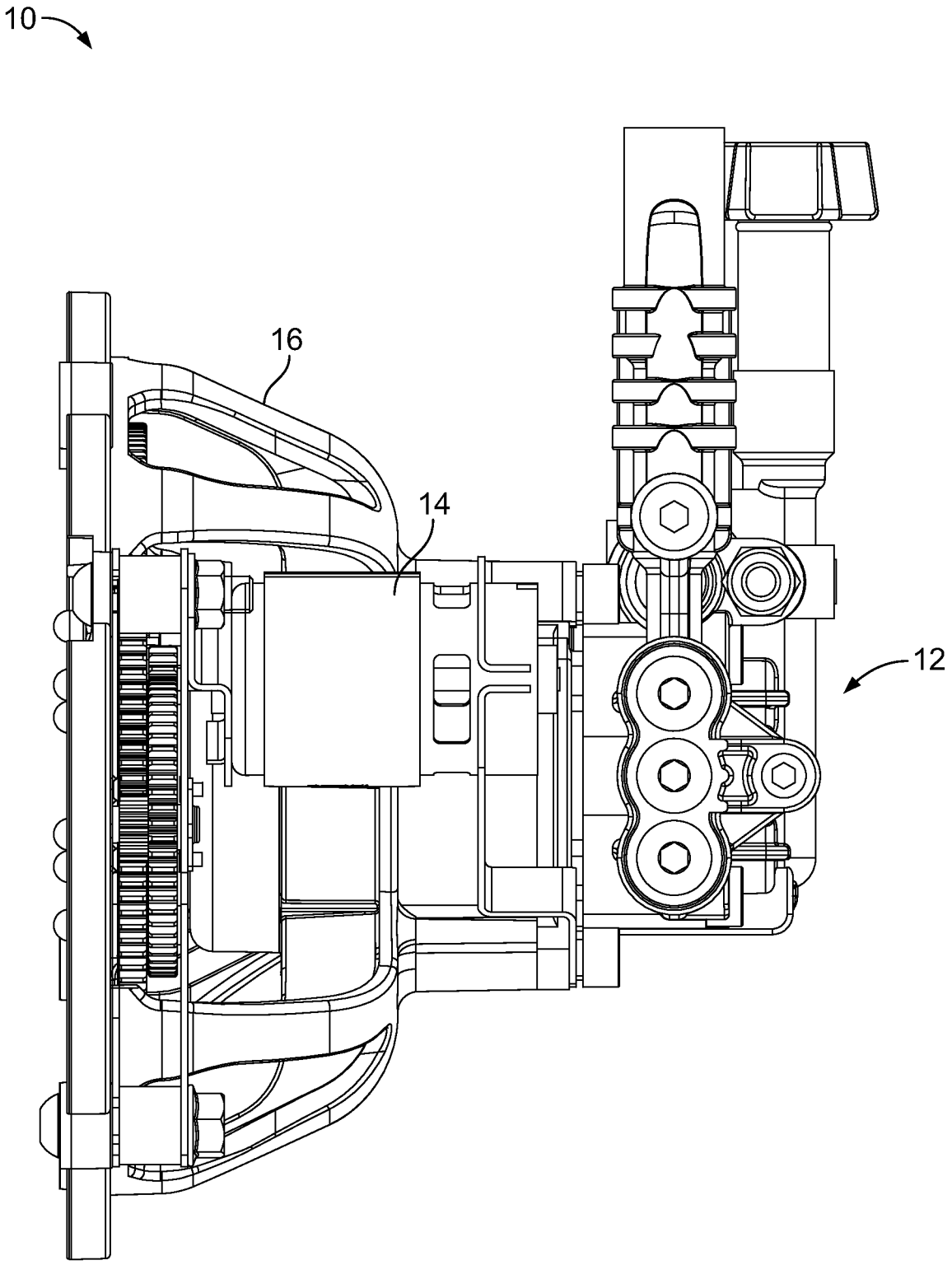
FIG. 4 is a side view of the pump assembly of FIG. 1, according to an example embodiment.
Figure 5:
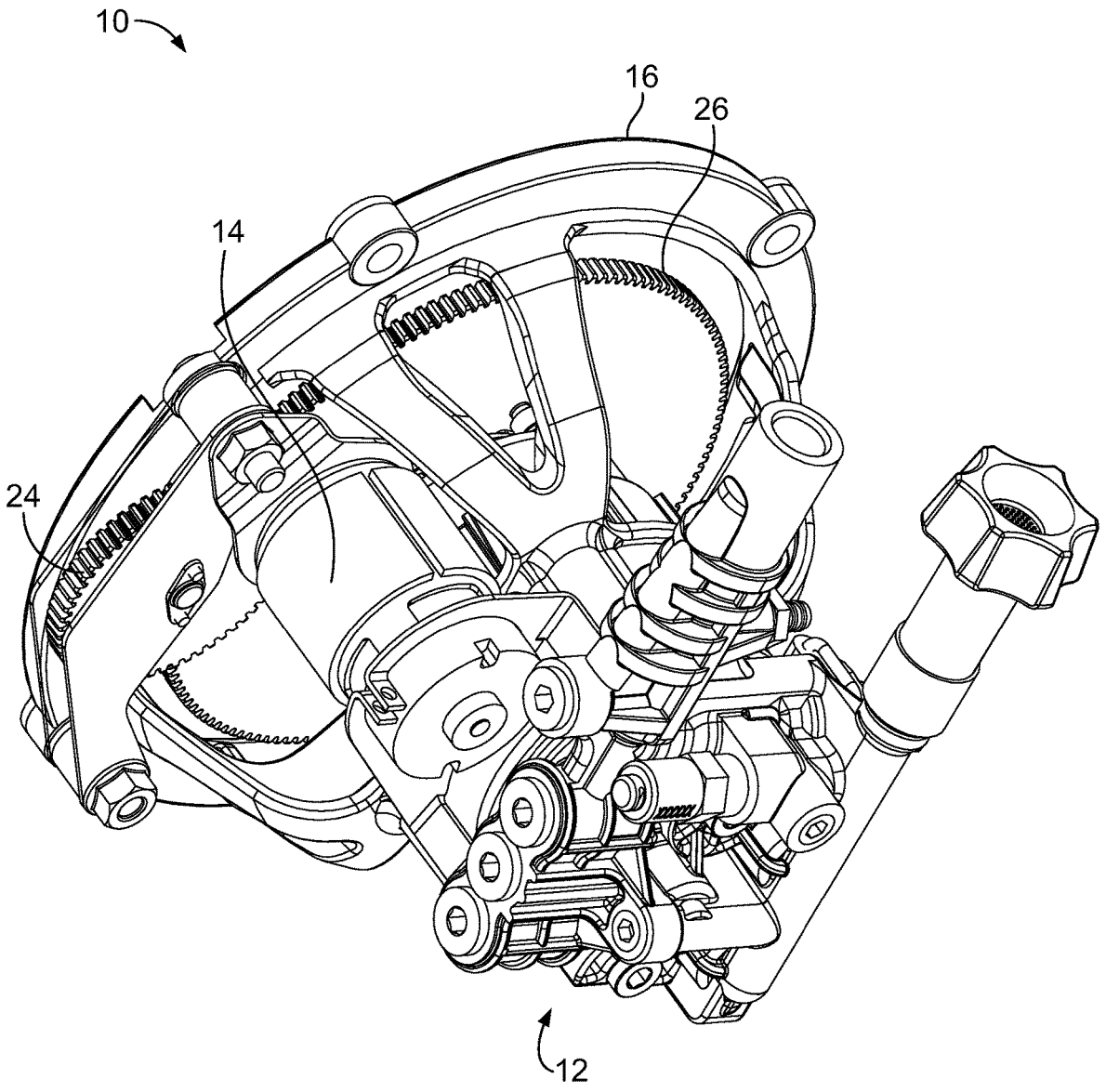
FIG. 5 is a top perspective view of the pump assembly of FIG. 1, according to an example embodiment.

According to an embodiment, the present disclosure may generally provide a pump assembly that may include an electric starter mechanism for a prime mover that may drive, or otherwise provide a power input, for the pump. In some embodiments, the pump assembly may include a pump assembly that may suitably be used in connection with a pressure washer. Further, the electric starter mechanism may provide electric starting capabilities for a prime mover engine, such as a gasoline engine, a propane engine, diesel engine, or other suitable engine for driving the pump. Consistent with such embodiments, a prime mover engine that may not otherwise be provided with electric starting capabilities may, when used in conjunction with a pump assembly of the present disclosure, may be capable of being electrically started, automatically and/or manually, (e.g., rather than being started with a pull-cord starting mechanism, or other similar starting mechanism). As such, a pump assembly according to some embodiments may improve the ease of use and operation of a pressure washer by making the prime mover engine easier to start (e.g., through requiring less physical effort by the operator to start the prime mover engine).

In some implementations, a pump assembly consistent with the present disclose may be utilized as a retrofit component, and upgrade component, or similar type improvement, for an existing pressure washer that does not include electric starting capabilities for the prime mover engine. For example, a pressure washer including a conventional pump mechanism and a prime mover engine with a pull-cord starting mechanism may be retrofitted with a pump assembly consistent with the present disclosure to provide a pressure washer with electric starting capabilities for the prime mover engine. For example, the existing pump mechanism of the pressure washer may be removed from the pressure washer, as by decoupling a pump input shaft of the pump mechanism from the prime mover, and removing the pump mechanism from a chassis or mounting arrangement of the pressure washer. A pump assembly consistent with the present disclosure may then be coupled with the prime mover and secured to the chassis or mounting arrangement of the pressure washer. The retrofitted, or upgraded, pressure washer, now including a pump assembly consistent with the present disclosure, may prove electric starting capabilities for the prime mover engine. Such electric starting capabilities for the prime mover engine may increase the ease of operation of the pressure washer, e.g., as by reducing the physical effort required to start the prime mover engine. In some embodiments, the retrofitting may include providing controls (manual and/or automatic) for the choke and/or the throttle of the prime mover engine.

In an illustrative embodiment consistent with the present disclosure, a pump assembly may include a mounting structure. The pump assembly may also include a pump mechanism coupled to the mounting structure. The pump mechanism may include an input shaft configured to be rotatably coupled with an output shaft of a prime mover engine. The pump assembly may also include a starter motor coupled to the mounting structure. The starter motor may be coupled with the input shaft of the pump mechanism for rotatably driving the input shaft. For example, and referring to the drawings, in an illustrative example embodiment, in general a pump assembly 10 consistent with the present disclosure may include a pump mechanism 12, and a starter motor 14 coupled within a common mounting structure 16. While not shown, the common mounting structure 16 may be configured to be mounted to a prime mover engine and/or a chassis or housing of a pressure washer. For example, in some embodiments the common mounting structure 16 may be configured to mount (e.g., by bolting or other suitable mechanical fastening) directly to a structure (such as a housing or engine block) of the prime mover engine. In other embodiments, the common mounting structure 16 may be configured to be mounted a chassis or a housing of the pressure washer, to which the prime mover engine may also be mounted. In this manner, the pump assembly 10 may be mounted to the pressure washer such that the pump mechanism 12 may be driven by the prime mover engine of the pressure washer.

Figure 6:
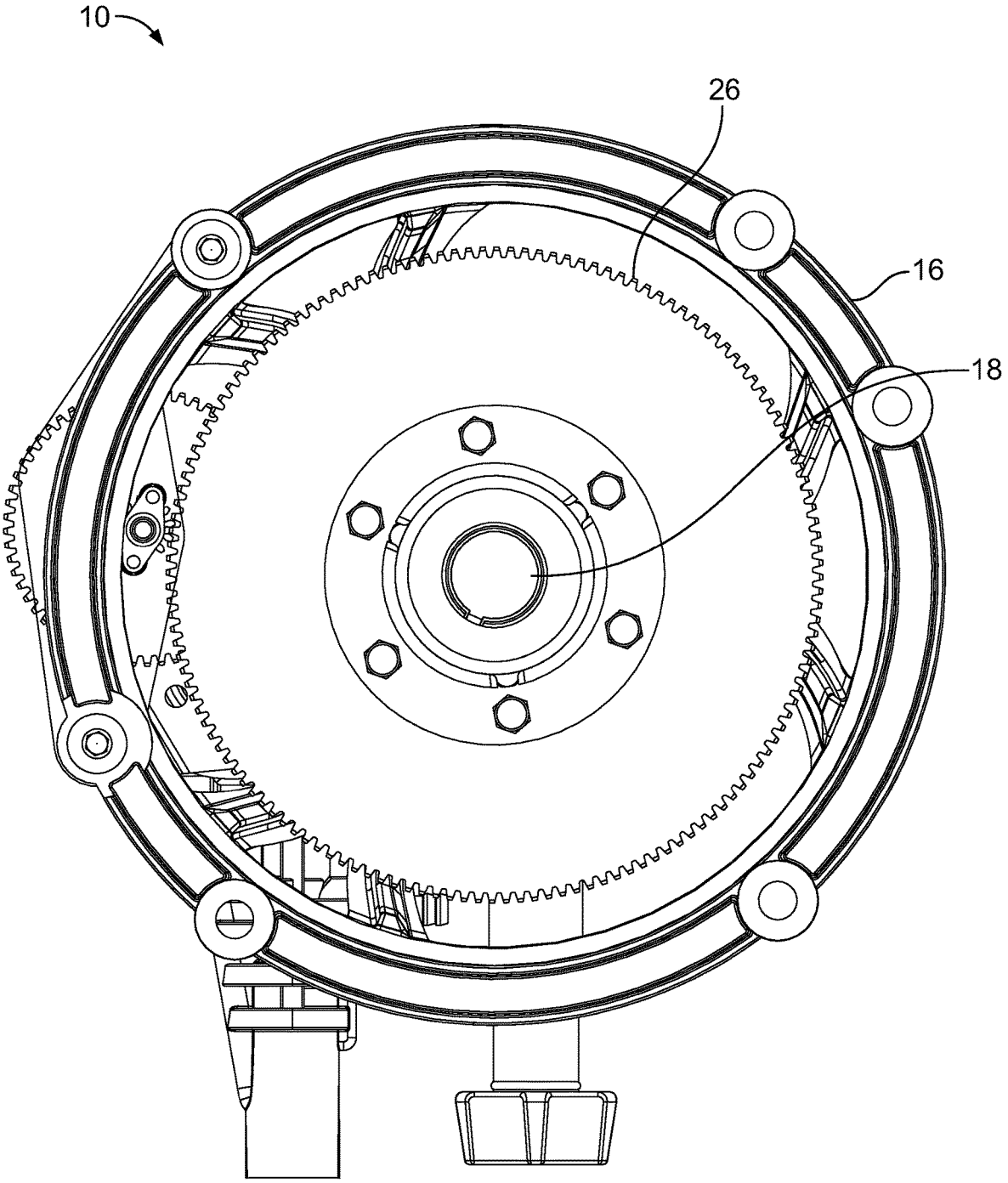
FIG. 6 is a bottom view of the pump assembly of FIG. 1, according to an example embodiment.
Figure 7:
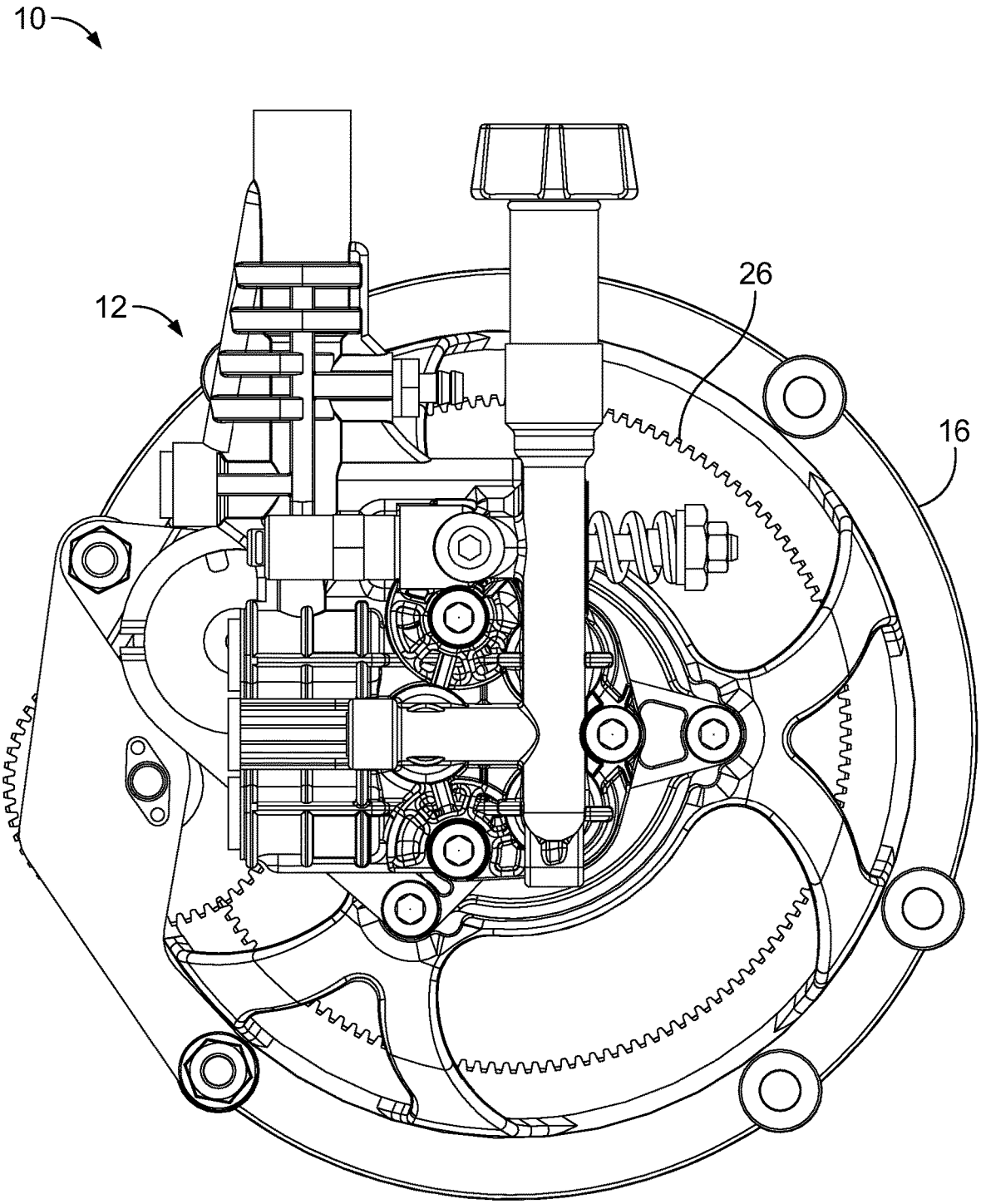
FIG. 7 is a top view of the pump assembly of FIG. 1, according to an example embodiment.
Figure 8:
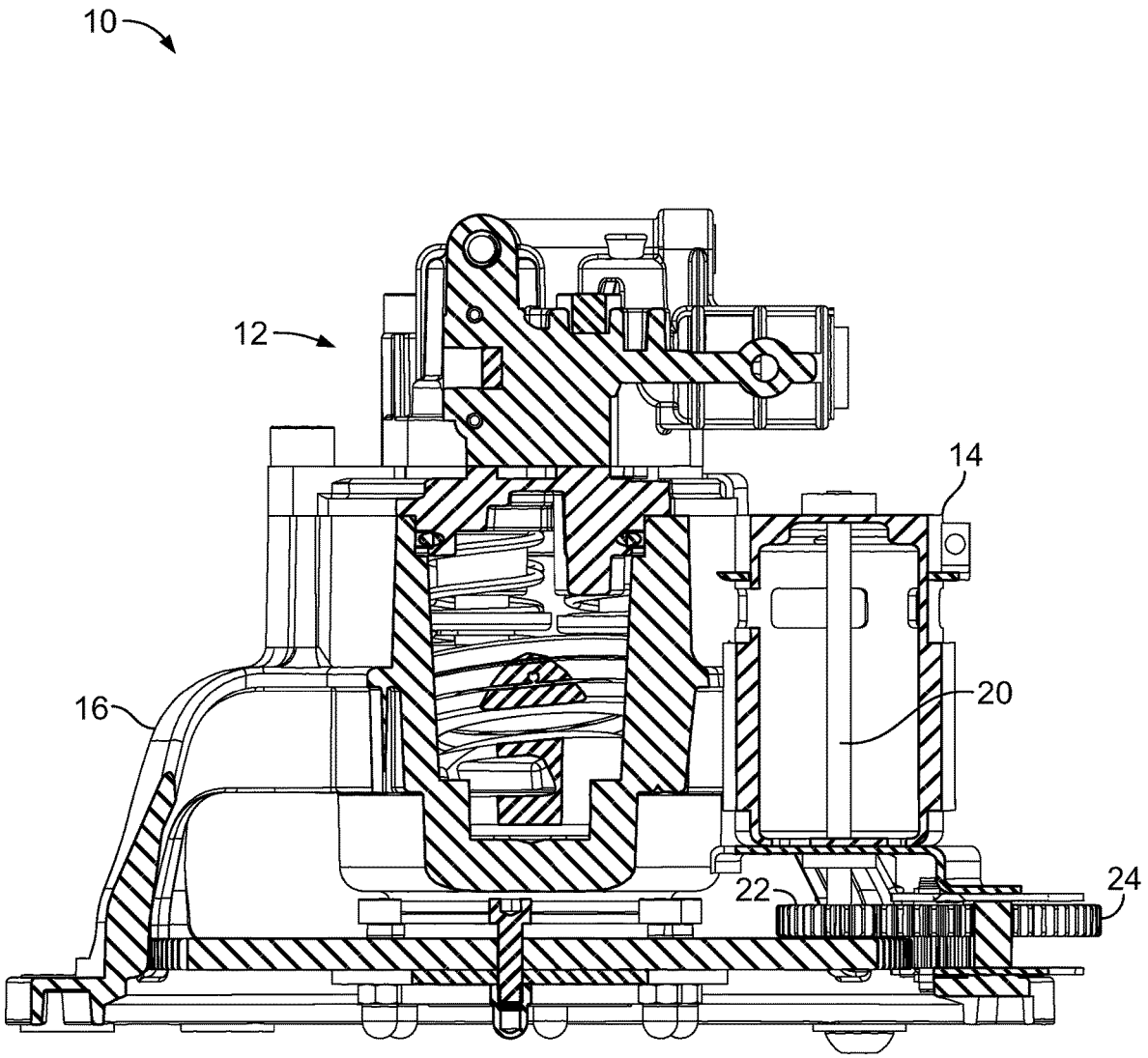
FIG. 8 is a partial cross-sectional rear view of the pump assembly of FIG. 1, according to an example embodiment.
Figure 9:
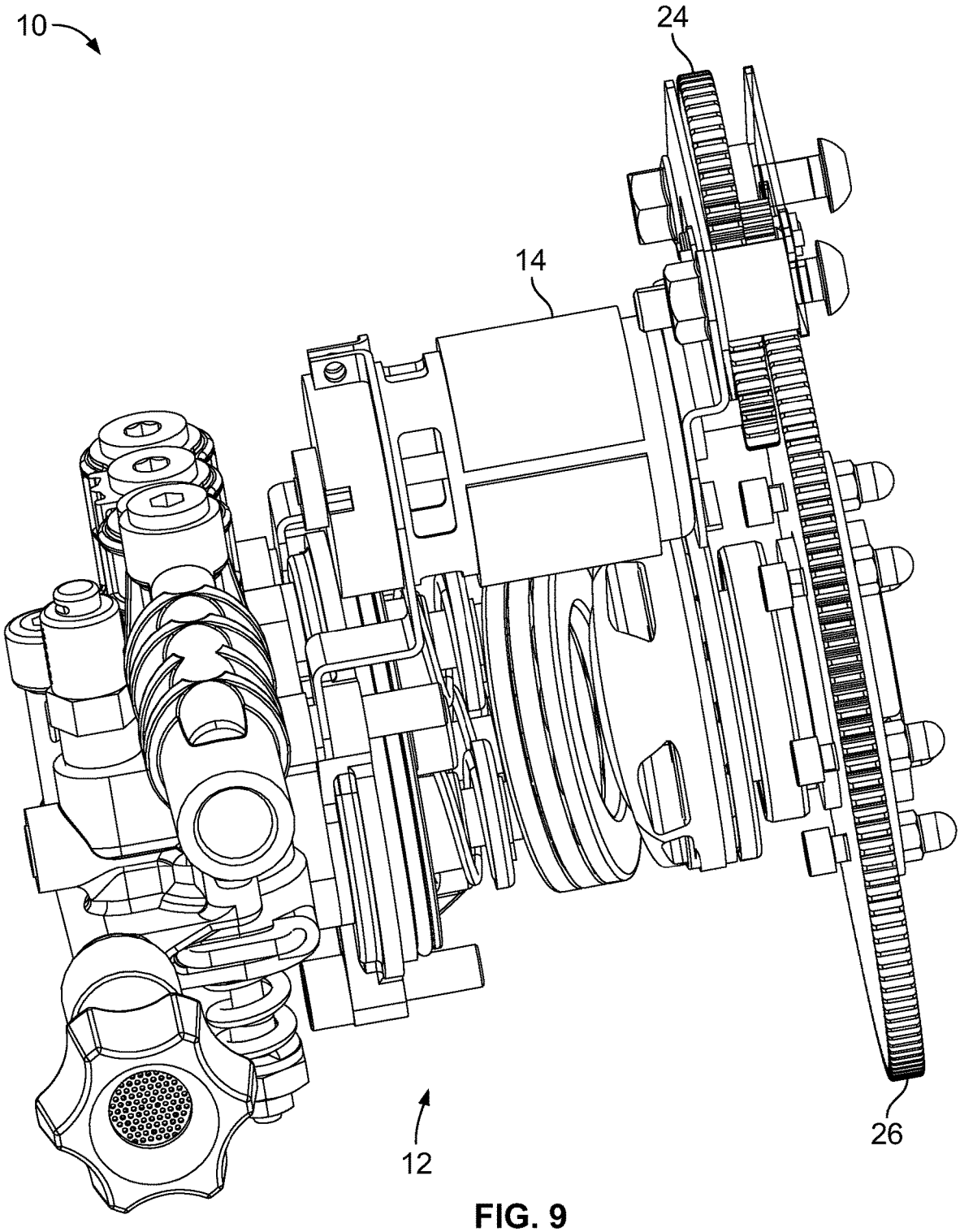
FIG. 9 is a perspective view of the pump assembly of FIG. 1 with the mounting structure removed and with the housing of the pump mechanism removed, according to an example embodiment.
Figure 10:
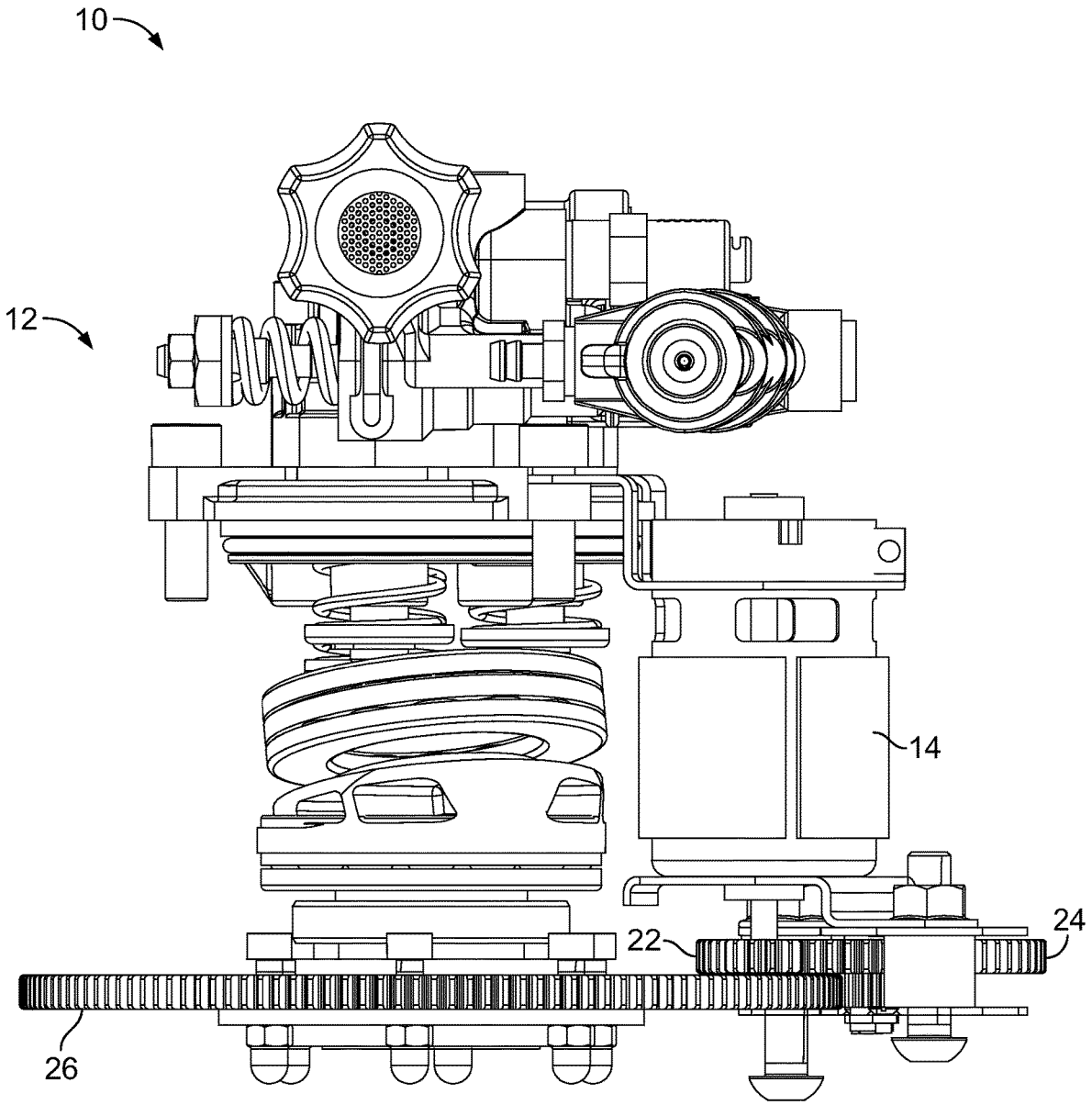
FIG. 10 is a rear view of the pump assembly of FIG. 1 with the mounting structure removed and with the housing of the pump mechanism removed, according to an example embodiment.

As shown in the illustrated example embodiment, the pump mechanism 12 may be coupled to, and/or at least partially disposed within or contained by the mounting structure. The pump mechanism 12 may include any suitable pump variety, e.g., as may commonly be used in connection with a pressure washer. For example, and as shown in FIG. 8 through 10, in an illustrative example embodiment the pump mechanism 12 may include an axial piston pump. In such an implementation, one or more axial piston pumps may be axially driven by a rotating swashplate. For example, the axis of reciprocation of the one or more axial piston pumps may be generally parallel to the axis of rotation of the rotating swashplate. The swashplate may be rotationally driven by the prime mover engine, e.g., via an input shaft of the pump mechanism 12 and/or one or more intervening coupling features. For example, and referring also to FIG. 6, pump mechanism 12 may include an input shaft 18 for receiving a rotational input from the prime mover engine. In the example of an axial piston pump, the input shaft 18 may be coupled for rotating the swashplate of the pump mechanism 12, although other configurations may also be employed. Consistent with various suitable arrangements, the input shaft 18 may be configured to be coupled with an output shaft of the prime mover engine via a keyed shaft arrangement, a splined arrangement, a lovejoy coupling, or any other suitable shaft coupling. While not particularly described, the pump mechanism may include various valves (e.g., check valves, pressure control valves, regulators, etc.), fluid conduits, fittings and the like. While the illustrative example has been described as an axial piston pump configuration, including one or more axial piston pumps driven by a rotating swashplate, it will be appreciated that the pump mechanism 12 may include various other types of pumps. For example, pump mechanism 12 may include, but is not limited to a crank driven piston pump, an impeller pump, a vane pump, a gear pump, or any other suitable pump mechanism.

Consistent with the depicted example embodiment, the pump assembly 10 may also include a starter motor 14, which may also be coupled to and/or at least partially disposed within and/or contained by the mounting structure 16. In general, the starter motor 14 may be coupled with the input shaft 18 of the pump mechanism 12 for rotatably driving the input shaft 18. In one embodiment, the starter motor 14 may include an electric motor coupled for providing a uni-directional rotational driving force to the prime mover engine output shaft via the pump input shaft 18 of the pump mechanism 12. In various embodiments, the starter motor 14 may include any suitable AC or DC electric motor. In some implementations, the starter motor 14 may include a DC motor, such as a high speed DC motor. In such implementations, the DC motor may include a high speed DC motor, such as a universal motor, or a brushless DC motor. According to an embodiment, a high speed DC motor may rotationally drive the input shaft 18 of the pump via a mechanical coupling between the starter motor 14 and the pump mechanism 12. In another example embodiment, the starter motor 14 may include a low speed DC "pancake" motor (e.g., a motor having a form factor including a diameter that is proportionally larger than the height of the motor), or a low speed DC SRM motor (switched reluctance motor), as well as DC motors that utilized technologies other than permanent magnet motors. In some implementations using a "pancake" or SRM motor, the starter motor 14 may be directly assembled over the input shaft of the pump. For example, a portion of the input shaft of the pump mechanism 12 may form at least a portion of the motor rotor or motor shaft.

As generally mentioned above, the starter motor 14 may be coupled with the input shaft 18 of the pump mechanism 12, such that the starter motor 14 may rotationally drive the input shaft 18 of the pump mechanism, which may thereby rotationally drive the output shaft of the prime mover engine (e.g., which may be rotationally coupled with the input shaft 18 of the pump mechanism 12). As such, in some embodiments, the pump assembly 10 may include a mechanical coupling between the starter motor 14 and the input shaft 18 of the pump mechanism. The mechanical coupling between the starter motor 14 and the input shaft 18 of the pump mechanism may include any suitable mechanical coupling that may transmit the rotational output of the starter motor 14 to input shaft 18 of the pump mechanism 12, so as to impart a rotational motion on the input shaft 18. Additionally, and as generally discussed above, in some implementations the mechanical coupling between the starter motor 14 and the input shaft 18 of the pump mechanism 12 may be configured such that the starter motor may uni-directionally drive the input shaft 18 of the pump mechanism 12.

According to various implementations, the mechanical coupling between the starter motor 14 and the input shaft 18 of the pump mechanism 12 may include, but is not limited to, a gear drive arrangement, a belt drive arrangement, a chain drive arrangement, or a friction wheel or friction disk drive arrangement. Further, and in particular in an embodiment in which the starter motor 14 may include a high speed DC motor, the mechanical coupling between the starter motor 14 and the input shaft 18 of the pump mechanism 12 may provide an appropriate mechanical multiplier. For example, the mechanical multiplier of the mechanical coupling may reduce the relatively high rotational speed of the starter motor 14 to a desired rotational speed imparted to the input shaft 18 of the pump mechanism 12 to effectuate starting of the prime mover engine. Similarly, the mechanical multiplier of the mechanical coupling may increase the torque provided by the starter motor 14 to a desired torque imparted to the input shaft 18 of the pump mechanism 12 to effectuate starting of the prime mover engine (e.g., to provide a sufficient and/or effective torque for cranking the prime mover engine).

In an implementation in which the starter motor 14 may include a low speed DC motor, such as a pancake motor or an SRM motor, the mechanical coupling between the starter motor 14 and the input shaft 18 of the pump mechanism 12 may include a variety of arrangements. For example, in an embodiment a rotor of the starter motor 14 may be keyed or splined around the input shaft 18 of the pump mechanism 12. In other embodiments, the rotor of the starter motor 14 may include at least a portion of the input shaft 18 of the pump mechanism 12. For example, the rotor of the starter motor 14 may be integrally formed on at least a portion of the input shaft 18 of the pump mechanism 12. It will be appreciated that other arrangements may also be utilized.

With continued reference to the drawings, in the illustrated embodiment the starter motor 14 may include a high speed DC motor, and the mechanical coupling between the starter motor 14 and the input shaft 18 of the pump mechanism 12 may include a gear train. For example, output shaft 20 of starter motor 14 (e.g., best observed in FIG. 8) may include a pinion 22 driven by the starter motor 14. The pinion 22 of starter motor 14 may drive the large wheel of compound gear 24. Further, the small wheel of compound gear 24 may drive the starter gear 26 that is coupled to the input shaft 18 of the pump mechanism 12. The starter gear 26 may be coupled to the input shaft 18 of the pump mechanism 12 by any suitable arrangement (e.g., keyed interface, spline interface, flanged attachment, etc.). In the illustrative example embodiment, the gear train (including pinion 22, compound gear 24, and starter gear 26) may provide a desired mechanical multiplier (e.g., a gear reduction) to reduce the rotational speed imparted to the input shaft 18 of the pump mechanism 12 by the starter motor 14 (i.e., reduce the relatively high speed at the output shaft 20 of the starter motor 14 to a relatively low speed realized at the input shaft 18 of the pump mechanism 12). Further, the gear train may also increase the torque imparted to the input shaft 18 of the pump mechanism 12 by the starter motor (i.e., increase the relatively low torque at the output shaft 20 of the starter motor 14 to a relatively higher torque realized at the input shaft 18 of the pump mechanism 12) to provide an effective cranking torque sufficient to crank the prime mover engine (e.g., crank the prime mover engine against the piston compression and mechanical friction in the engine). It will be appreciated that while a relatively linear gear train has been depicted in the illustrated embodiment, other arrangements may be utilized. For example, the mechanical coupling between the starter motor 14 and the input shaft 18 of the pump mechanism 12 may include one or more linear gear train components, planetary gear train components, combinations of linear and planetary gear train components, and/or other mechanical coupling arrangements.

In the illustrated embodiment, the gear train of the mechanical coupling between the starter motor 14 and the input shaft 18 of the pump mechanism 12 is generally located adjacent a portion of the input shaft 18 that may be rotatably coupled with the prime mover engine. However, the depicted arrangement is intended only for the purpose of illustration. Depending upon the type of pump, and the configuration of the pump, the mechanical coupling between the starter motor 14 and the input shaft 18 of the pump mechanism may be located away from an anticipated coupling interface between the pump mechanism 12 and the prime mover engine. For example, the mechanical coupling between the starter motor 14 and the input shaft 18 of the pump mechanism 12 may be distal relative to the anticipate coupling interface between the pump mechanism and the prime mover engine, with the rotational starting force provided by the starter motor 14 being transmitted to the prime mover engine via the input shaft 18 of the pump mechanism.

In some embodiments, the starter motor 14 may be configured for selective engagement/disengagement with the input shaft 18 of the pump mechanism 12. Consistent with such embodiments, the pump assembly 10 may include a selective engagement mechanism coupled between the starter motor 14 and the pump mechanism 12. The selective engagement mechanism may provide selective rotational and/or directional driving engagement and disengagement between the starter motor 14 and the input shaft 18 of the pump mechanism 12. According to various embodiments, the selective engagement mechanism may include a component or feature of the starter motor 14, a component or feature associated with the input shaft 18, and/or may include a component or feature of the mechanical coupling between the starter motor 14 and the input shaft 18. Consistent with the foregoing, in an example embodiment, the starter motor 14 may be configured to be rotatably engaged with the input shaft of the pump mechanism 12 during starting of the prime mover engine, and may be disengaged from the input shaft 18 of the pump mechanism 12 while the prime mover engine is running and/or when the pump assembly is not in operation. In some such implementations, when the starter motor 14 is rotatably disengaged from the input shaft 18 of the pump mechanism 12, rotation of the input shaft 18 of the pump mechanism 12 (e.g., as through driving rotation of the input shaft 18 of the pump mechanism 12 by the prime mover engine) may not be transmitted upstream to the starter motor 14. As such, in some embodiments, the starter motor 14 may not be rotated by the rotation of the input shaft 18 of the pump mechanism 12 imparted by the prime mover engine.

It will be appreciated that a variety of selective engagement mechanisms may be utilized to achieve the selective engagement between the starter motor 14 and the input shaft 18 of the pump mechanism 12. For example, the selective engagement mechanism may include an overrunning clutch. In an example embodiment, the overrunning clutch, or other selective engagement mechanism, may generally be configured to engage to allow transmission of rotational force from the starter motor 14 to the input shaft 18 of the pump mechanism 12. Further, the overrunning clutch, or other selective engagement mechanism, may be configured to disengage to prevent and/or reduce the transmission of rotational force from the input shaft 18 of the pump mechanism 12 to the starter motor 14. In some embodiments, the selective engagement mechanism may disengage the starter motor 14 from being rotated by rotation of the input shaft 18 of the pump mechanism 12 when the rotational speed of the input shaft 18 of the pump mechanism 12 is greater than the rotational speed of the starter motor 14, when taking into consideration any mechanical multiplier provided by the mechanical coupling (e.g., gear train or the like) between the starter motor 14 and the input shaft 18 of the pump mechanism 12.

Figure 11:
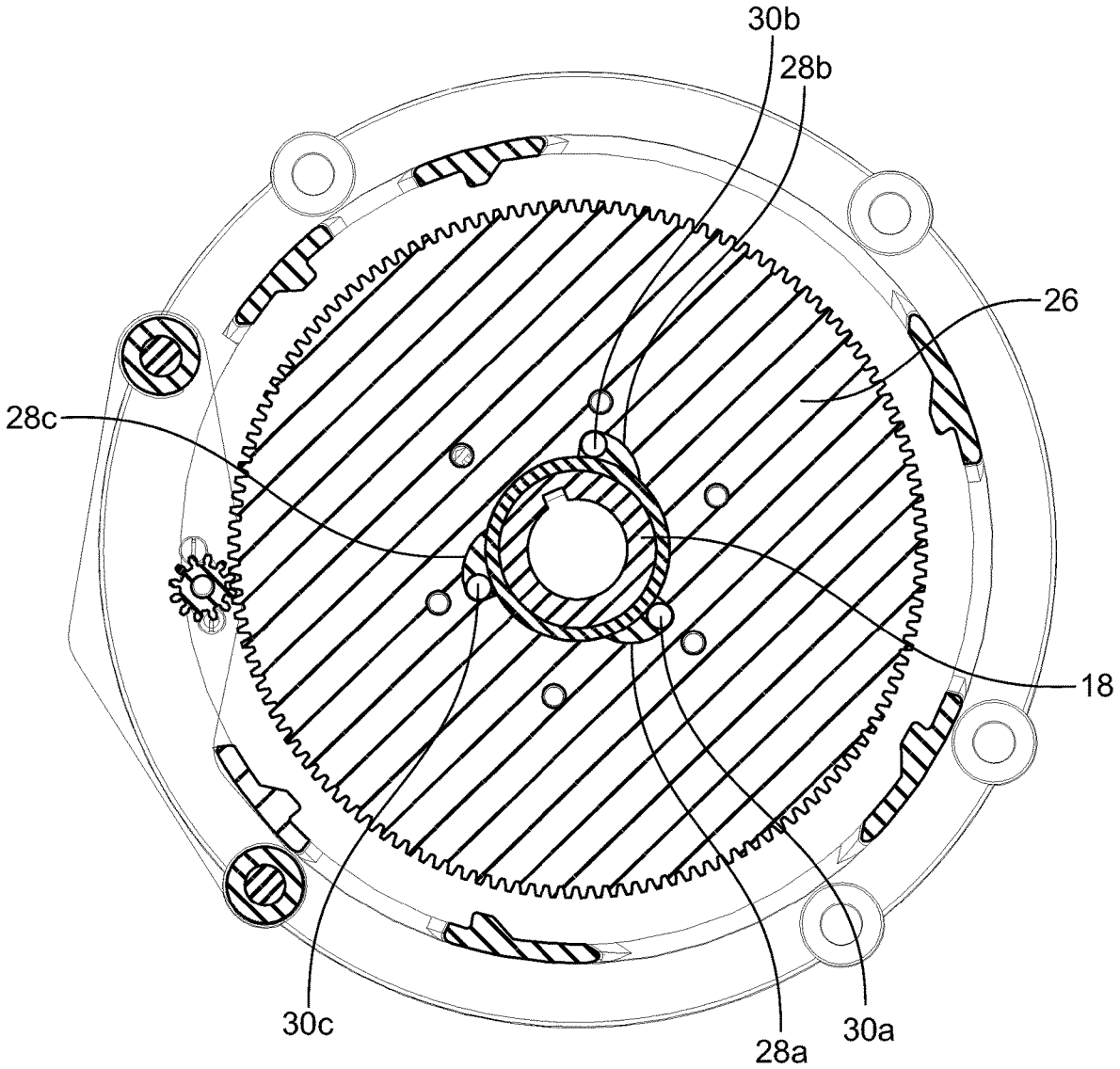
FIG. 11 is a cross-sectional view of the pump assembly of FIG. 1 depicting an illustrative example embodiment of an overrunning clutch.

With specific reference to FIG. 11, an illustrative example embodiment of an overrunning clutch is generally depicted. In the illustrated embodiment, the overrunning clutch may include an outer race portion surrounding at least a portion of the input shaft 18 of the pump mechanism 12. In the depicted example embodiment, the outer race portion may generally be formed in the starter gear 26. However, it will be appreciated that the outer race portion may include a separate component from the starter gear 26. The outer race portion may define one or more tapered pockets (e.g., tapered pockets 28*a*, 28*b*, 28*c*). In some embodiments, and as shown in FIG. 11, the one or more tapered pockets may include progressively curved channels. A respective ball bearing (e.g., ball bearings 30*a*, 30*b*, 30*c*) may be disposed in each of the one or more tapered pockets. In addition/as an alternative to ball bearings, respective rollers may be disposed in each tapered pocket. In such an embodiment an axis of rotation of the rollers may generally be parallel to the axis of the input shaft 18 of the pump mechanism 12. The input shaft 18 of the pump mechanism 12 may define an inner race portion. The inner race portion may generally form an inner boundary of the one or more tapered pockets. The respective ball bearings may interact between the inner race portion and the outer race portion.

For example, during rotation of the starter gear (e.g., in response to the starter 14 being energized) in a counterclockwise direction in FIG. 11, the ball bearing may interact with the inner and outer race portions to be urged toward the relatively narrower portion of the tapered pockets. As the ball bearings are urged toward the relatively narrower portion of the tapered pockets the ball bearings may jam between the inner race portion and the outer race portion, which may prevent and/or inhibit the ball bearings from rotating between the inner race portion and the outer race portion. Accordingly, when the ball bearings jam between the inner race portion and the outer race portion, the starter gear 26 may impart a rotational force on the input shaft 18. When the prime mover engine is operating, the input shaft 18 may be driven by the output shaft of the prime mover engine. When the input shaft 18 rotates in a counterclockwise direction at a speed greater than an rotational speed of the starter gear 26 (e.g., when the starter motor is not energized and/or the rotational speed of the prime mover output shaft is greater than an effective rotational speed of the starter gear under the influence of the starter motor 14) the ball bearings may be urged toward the relatively wider portion of the tapered pockets. When the ball bearings are urged toward the relatively wider portion of the tapered pockets sufficient clearance may be provided to allow the ball bearings to rotate relative to the inner race portion and the outer race portion. As such, the inner race portion may rotate independently from outer race portion. Accordingly, the rotational movement of the input shaft may not impart a rotational force on the starter gear 26 (and there by the starter motor 14). Consistent with the illustrated embodiment, the starter gear 26 may be coupled with the input shaft via the overrunning clutch.

In addition/as an alternative to an overrunning clutch, other selective engagement mechanisms may similarly be utilized, such as other mechanical or electo-mechanical clutch mechanisms, solenoid actuated engagement mechanisms (such as selective sliding engagement between members of the gear train or other mechanical coupling, selective loosening and tightening of belt drives, or the like), Bendix drive-type engagement mechanisms, or any other suitable selective engagement/disengagement mechanisms. In this regard the foregoing discussed selective engagement/disengagement mechanism should be considered as illustrative, but not limiting, as various known mechanism may be utilized to decouple the starter motor 14 from the input shaft 18 of the pump mechanism, and/or from intermediary mechanical coupling features, when the pump mechanism 12 is being driven by the prime mover engine and/or when the prime mover engine is operating above a threshold rotational speed. Depending upon the exact selective engagement/disengagement mechanism utilized various sensors (e.g., rotational speed sensors, prime mover engine operation sensors, or the like), and associated control systems may be included for controlling the selective engagement/disengagement of the starter motor 14. It will be appreciated that the selective engagement mechanism may be included within the starter motor 14, within the gear train, and or as an intermediary component mechanically coupled at some point (and/or integrated into some component) between the starter motor 14 and the input shaft 18 of the pump mechanism.

In some implementations, such as embodiments including a low speed DC pancake motor or an SRM motor, the starter motor 14 may be configured to spin freely with the input shaft 18 of the pump mechanism 12. For example, in some implementations, depending upon the configuration of the starter motor 14, the starter motor may be de-energized once the prime mover engine has been started (e.g., as may be determined by rotational speeds of the input shaft 18 of the pump mechanism 12 above a predetermined threshold, and/or as may be determined by other sensors and/or determinations). In some such embodiments, once the starter motor 14 has be de-energized, the starter motor 14 may be capable of spinning freely with the input shaft 18 of the pump mechanism 12 without experiencing damage or other detrimental effects.

Consistent with the present disclosure, an embodiment of a pump assembly 10 may include a power coupling for selectively coupling the starter motor 14 with a power source for energizing the starter motor 14. The starter motor 14 may be energized to provide rotation of the input shaft 18 of the pump mechanism 12 for starting the prime mover engine using any suitable power source. For example, in some embodiments the pump assembly 10 may be configured to electrically couple the starter motor 14 with a suitable battery via a battery coupling. The battery coupling may electrically and/or mechanically couple the pump assembly 10 (e.g., which may include the starter motor 14) with any suitable battery. In some embodiments, the battery may include a battery as may be commonly utilized with small engines having integrated electric starting systems. Consistent with such an embodiment, the battery coupling may include electrical connections (e.g., such as battery cables including terminal ends) that may be configured to be electrically and/or mechanically coupled with terminals of the battery. In some embodiments, the battery coupling may additionally include a battery tray or battery box for at least partially retaining the battery. In some embodiments, the battery may include a battery of the variety utilized for powering battery powered tools, such as battery powered drills and saws. In such an implementation, the battery may include a rechargeable battery (such as a NiCad battery, a lithium ion battery, a nickel metal hydride battery, or other suitable battery). In such an embodiment, the battery may be charged using a conventional charging station appropriate to the type and manufacture of battery being utilized. Consistent with one such example embodiment, the battery coupling may allow the battery to be mechanically and/or electrically engaged with the pump assembly 10 in a generally conventional manner (e.g., as is commonly utilized for battery powered tools). In some embodiments, the pump assembly 10 may include one or more battery adapters, e.g., which may allow batteries from different manufacturers to be utilized for powering the starter motor 14. In some embodiments, the power coupling may include a plug for coupling with a residential electrical system. For example, the pump assembly 10 may include an electrical plug, e.g., of the variety that may be coupled with a household extension cord and/or a custom plug configuration. In such an embodiment, the pump assembly 10 may be coupled to a remote power source, such as a residential electrical system, or the like, for the purpose of energizing the starter motor 14 for starting the prime mover engine. Once the prime move engine has been started, the pump assembly may be unplugged from the extension cord (e.g., to allow movement of the pump assembly outside of the range of the extension cord and/or to provide untethered movement of the pump assembly). It will be appreciated that various other arrangements for powering the starter motor may also be utilized.

The pump assembly 10 may include various wiring harness, controls, and sensors associated with the starter system. For example, an activation switch may be included for energizing the starter motor 14 and/or for selectively engaging the starter motor 14 with the input shaft 18 of the pump mechanism 12. Similarly, various sensors and controls may be included, such as for detecting when the prime mover engine has been started, for disengaging the starter motor 14, and the like. Further, suitable wiring harnesses may be included for providing the necessary electrical connections between the starter motor 14, the power supply (e.g., batter or plug), any switch gear or controls, and any sensors included to facilitate operation of the starter motor 14 for starting the prime mover engine.

Consistent with the present disclosure, and as shown in the illustrated example embodiments, the starter motor 14, the pump mechanism 12, the mechanically coupling between the starter motor 14 and the pump mechanism 12, the selective engagement mechanism, as well as various other features included to facilitate operation of the electric start system, may be integrated with the pump assembly. For example, as shown in the illustrated example embodiment, the pump mechanism 12, the starter motor 14, the gear train, and other component may be commonly attached to and/or contained within mounting structure 16. In related embodiments contemplated by the present disclosure, the starter motor 14, mechanical coupling, selective engagement mechanism, as well as any sensors and/or controls, may be integrated into and/or coupled to a housing of the pump mechanism 12, e.g., without necessitating a separate mounting structure. Accordingly, pump assembly 10 may be attached to a prime mover engine, and/or to a pressure washer chassis or housing, as a single assembly. Consistent with the present disclosure, the pump assembly 10 may provide added precision and reduced costs associated with providing electric start capabilities for a pressure washer that utilized a prime mover engine that does not itself include electric start capabilities. In this regard, the pump assembly of the present disclosure may allow the retrofitting, replacement, or upgrade of a pressure washer to add electric start capabilities for the pressure washer.

While the present disclosure has generally been described in the context of a pump assembly for a pressure washer, such description has been presented for the purpose of illustration. It will be appreciated that a pump assembly consistent with the present disclosure may be utilized for a variety of purposes. As such, the present disclosure is considered to be broadly directed at any pumping application, in which a prime mover engine may be used to drive a pump, and in which an electric starting mechanism associated with a pump assembly may be utilized to provide electric starting capabilities for the prime mover engine.

A variety of features of the variable flow rate pump have been described. However, it will be appreciated that various additional features and structures may be implemented in connection with a pump according to the present disclosure. As such, the features and attributes described herein should be construed as a limitation on the present disclosure.

What is claimed is:

1. A pump assembly comprising:

a mounting structure;

a pump mechanism coupled to the mounting structure, the pump mechanism including an input shaft configured to be rotatably coupled with an output shaft of a prime mover engine; and a starter motor coupled to the mounting structure, the starter motor coupled with the input shaft of the pump mechanism for rotatably driving the input shaft by a selective engagement mechanism for starting the prime mover engine, the selective engagement mechanism including an overrunning clutch comprising:

an outer race portion surrounding at least a portion of the input shaft of the pump;

an inner race portion defined by the input shaft of the pump; and a plurality of ball bearings disposed between the inner race portion and the outer race portion for providing selective rotational engagement therebetween.

2. The pump assembly according to claim 1, wherein the mounting structure is configured to be mounted to the prime mover engine.

3. The pump assembly according to claim 1, wherein the mounting structure is configured to be mounted to a pressure washer chassis, and wherein the prime mover engine is mounted to the pressure washer chassis.

4. The pump assembly according to claim 1, wherein the pump mechanism includes an axial piston pump including one or more pistons driven by a swashplate rotatably coupled with the input shaft.

5. The pump assembly according to claim 1, wherein the starter motor is coupled with the input shaft of the pump mechanism by a mechanical coupling including one or more of a gear drive, a belt drive, a chain drive, and a friction wheel drive.

6. The pump assembly according to claim 5, wherein the mechanical coupling provides a mechanical multiplier to provide sufficient torque at the input shaft of the pump mechanism to start the prime mover engine.

7. The pump assembly according to claim 1, wherein the starter motor is assembled over the input shaft of the pump mechanism.

8. The pump assembly according to claim 1, wherein the selective engagement mechanism provides selective rotational driving engagement and disengagement between the starter motor and the input shaft of the pump mechanism.

9. The pump assembly according to claim 8, wherein the overrunning clutch is configured to engage to allow transmission of rotational force from the starter motor to the input shaft of the pump mechanism and configured to disengage to prevent transmission of rotational force from the input shaft of the pump mechanism to the starter motor.

10. The pump assembly according to claim 9, wherein:

the outer race portion defines one or more tapered pockets;

a respective one of the plurality of ball bearings is disposed in each of the one or more tapered pockets; and wherein the respective ball bearings interact between the inner race portion and the outer race portion.

11. The pump assembly according to claim 1, further comprising a power coupling for selectively coupling the starter motor with a power source for energizing the starter motor.

12. The pump assembly according to claim 11, wherein the power coupling includes a battery coupling.

13. The pump assembly according to claim 12, wherein the battery coupling includes a coupling for electrical connection with a battery of a battery powered tool.

14. The pump assembly according to claim 11, wherein the power coupling includes a plug for coupling with a residential electrical system.

15. The pump assembly according to claim 1, further comprising a starter control for selectively energizing the starter motor.

16. A pump assembly comprising:

a mounting structure;

an axial pump mechanism coupled to the mounting structure, the axial pump mechanism including one or more pistons configured to be axially driven by a rotatably driven swashplate, the swash plate configured to be rotatably driven by an input shaft of the axial pump mechanism, the input shaft of the axial pump mechanism configured to be rotatably coupled with an output shaft of a prime mover engine;

a starter motor coupled to the mounting structure, the starter motor mechanically coupled with the input shaft of the pump mechanism through a gear train for rotatably driving the input shaft, wherein the starter motor includes one or more of a brushless DC motor and a universal motor;

a selective engagement mechanism coupled between the starter motor and the axial pump mechanism, the selective engagement mechanism providing selective rotational driving engagement and disengagement between the starter motor and the input shaft of the pump mechanism wherein the selective engagement mechanism includes:

a starter gear concentrically disposed relative to the input shaft, and drivingly coupled with the gear train, the starter gear defining one or more tapered pockets around the input shaft;

a respective ball bearing disposed in each of the one or more tapered pockets; and an inner race portion defined by the input shaft, the respective ball bearing interacting between the inner race portion and the starter gear; and a battery coupling configured to electrically and mechanically couple with a battery of a battery powered tool, the battery coupling selectively electrically coupleable with the starter motor for energizing the starter motor.

17. The pump assembly according to claim 16, wherein the mounting structure is configured to be coupled with the prime mover engine.

18. A pressure washer comprising:

a prime mover engine including an output shaft configured to be rotatably driven during operation of the prime mover engine;

a pump assembly mounting structure coupled to the prime mover engine;

a pump mechanism coupled to the pump assembly mounting structure, the pump mechanism including an input shaft rotatably coupled with the output shaft of a prime mover engine; and a starter motor coupled to the pump assembly mounting structure, the starter motor coupled with the input shaft of the pump mechanism for rotatably driving the input shaft for starting the prime mover engine by a selective engagement mechanism coupled between the starter motor and the input shaft of the pump mechanism, the selective engagement mechanism providing selective rotational driving engagement and disengagement between the starter motor and the input shaft of the pump mechanism wherein the selective engagement mechanism includes:

a starter gear concentrically disposed relative to the input shaft, and drivingly coupled with a gear train, the starter gear defining one or more tapered pockets around the input shaft;

a respective ball bearing disposed in each of the one or more tapered pockets; and an inner race portion defined by the input shaft, the respective ball bearing interacting between the inner race portion and the starter gear.

* * * * *